US006032716A

United States Patent [19]

Mattey

[11] Patent Number: 6,032,716

[45] Date of Patent: Mar. 7, 2000

[54] BOTTOM STOP MECHANISM FOR A WINDOW COVERING

[75] Inventor: David E. Mattey, Ridgefield, Conn.

[73] Assignee: RollEase, Inc., Stamford, Conn.

[21] Appl. No.: 08/799,196

[22] Filed: Feb. 13, 1997

[51] Int. Cl.[7] ..... A47H 5/00

[52] U.S. Cl. ..... 160/84.04; 160/176.1; 160/177; 160/307; 160/321

[58] Field of Search ..... 160/84.01, 84.04, 160/166 R, 167 R, 168.1 R, 173 R, 176.1 R, 177 R, 178.1 R, 291, 292, 298, 307, 308, 321, 323.1

[56] References Cited

U.S. PATENT DOCUMENTS

| | | | |
|---|---|---|---|
| 1,507,324 | 9/1924 | Nevatt | 160/307 |
| 1,746,936 | 2/1930 | Hadden | 160/307 |
| 3,135,369 | 6/1964 | Nisenson et al. . | |
| 4,088,171 | 5/1978 | Schluep et al. | 160/170 R |
| 4,433,765 | 2/1984 | Rude et al. . | |
| 4,487,243 | 12/1984 | Debs | 160/176.1 R X |
| 4,623,012 | 11/1986 | Rude et al. | 160/243 |
| 4,697,630 | 10/1987 | Rude | 160/177 |
| 4,729,418 | 3/1988 | Rude | 160/323.1 |
| 5,123,472 | 6/1992 | Nagashima et al. | 160/170 R |
| 5,228,491 | 7/1993 | Rude et al. | 160/171 |
| 5,375,643 | 12/1994 | Rude | 160/321 |
| 5,482,105 | 1/1996 | Rude | 160/307 |
| 5,507,374 | 4/1996 | Rude | 160/8 |
| 5,628,356 | 5/1997 | Marocco | 160/176.1 R X |

*Primary Examiner*—Daniel P. Stodola
*Assistant Examiner*—Bruce A. Lev
*Attorney, Agent, or Firm*—Gottlieb, Rackman & Reisman, P.C.

[57] ABSTRACT

An inventive bottom stop mechanism uses one of the lift cords to operate. While the cord is unwinding from the shaft, the cord leaves the shaft along a line tangent to the shaft. As the last turn of cord is unwound from the shaft, and the point of attachment of the cord to the shaft passes that point of tangency, the angle of the cord with respect to the shaft changes. This change in angle of the cord is used to raise a pawl which engages a ratchet wheel to stop the shaft and prevent further rotation in that direction. When the direction of the shaft is reversed to again start winding the cord thereupon, the cord angle returns to its prior value, releasing the stop.

20 Claims, 8 Drawing Sheets

BOTTOM STOP MECHANISM FOR A WINDOW COVERING

BACKGROUND TO THE INVENTION

This invention relates to window coverings that are hung from a headrail in which are stored the cords that lift the window covering. Cords to be stored inside headrails are commonly wound, as the blind is raised, onto spools that are mounted on a rotating shaft. Or the cords are wound onto the rotating shaft itself.

Where rotating shafts are used, the shaft is usually caused to move in the axial direction so that the cords wind in a single layer thereupon. The axial movement is caused either by means of a screw or by the mechanism disclosed in U.S. Pat. No. 4,623,012. Screw mechanisms ordinarily have a built-in stop that is actuated by the advance of the screw itself. The mechanism of U.S. Pat. No. 4,623,012 normally does not require a stop because the cords can be wound onto the shaft in either direction. However, various types of operating mechanisms are used with shaft-winding systems and some of these are easier to operate in one direction than in the other. This difference becomes greater for heavier blinds. For these situations, a bottom stop is desirable so that one direction of rotation is always used for lifting the blind.

While it is possible to add a screw actuated stop to any rotating shaft mechanism, it is desirable that the stop be perfectly coordinated with the unwinding of the lift cords so that the stop is actuated just as the cords become fully unwound from the shaft.

SUMMARY OF THE INVENTION

The present inventive bottom stop mechanism uses one of the lift cords to operate the mechanism. While the cord is unwinding from the shaft, the cord leaves the shaft along a line tangent to the shaft. As the last turn of cord is unwound from the shaft, and the point of attachment of the cord to the shaft passes that point of tangency, the angle of the cord with respect to the shaft changes. This change in angle of the cord is used to raise a pawl which engages a ratchet wheel to stop the shaft and prevent further rotation in that direction. When the direction of the shaft is reversed to again start winding the cord thereupon, the cord angle returns to its prior value, releasing the stop.

Accordingly, it is an object of our invention to provide a stop mechanism to permit only a single direction of shaft rotation for raising a blind.

It is a further object of our invention to provide a stop mechanism for blinds that automatically is perfectly coordinated with the fully lowered position of the blind.

It is another object of our invention to provide a stop mechanism for the bottom position of window coverings that uses a minimum number of parts.

Other objects and advantages of our invention will become apparent from the descriptions that follow.

BRIEF DESCRIPTION OF THE DRAWINGS

Further understanding of our invention will become apparent upon consideration of the following detailed description in conjunction with the drawings, in which.

DETAILED DESCRIPTION OF THE DRAWINGS

Figure 1:
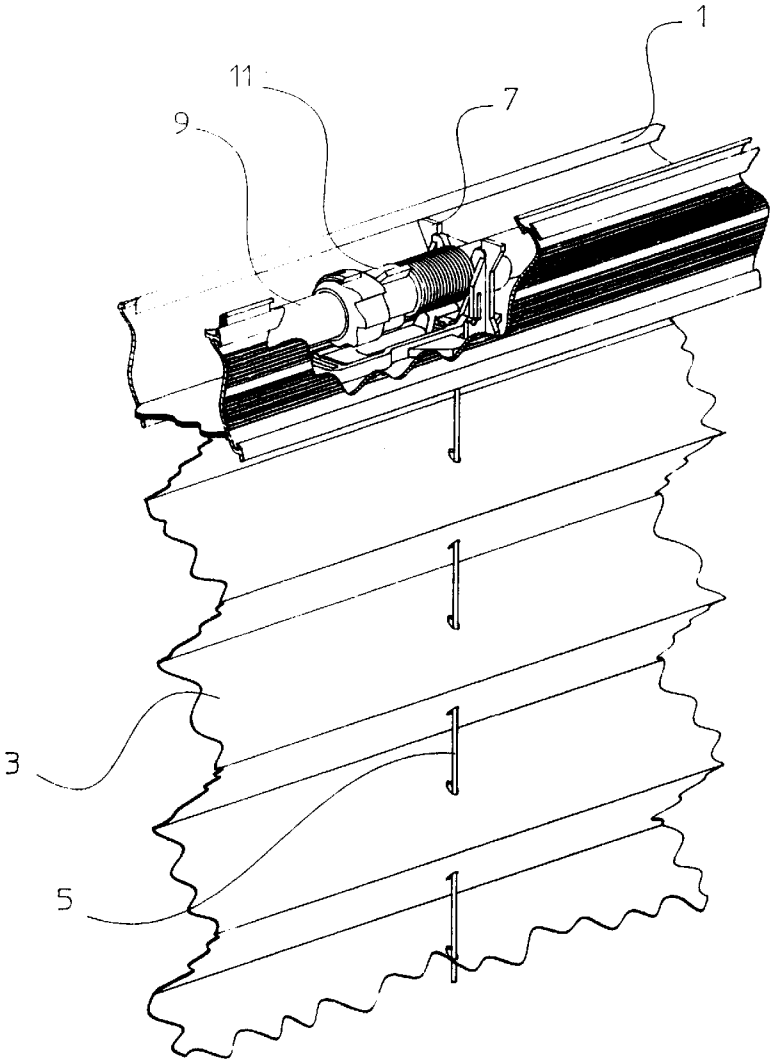
FIG. 1 is perspective view of a portion of a blind and headrail with the headrail partially cut away to reveal the preferred embodiment of the shaft stop mechanism therewithin.

The preferred embodiment of our invention uses a traversing shaft for the accumulation of the lift cords within the headrail. The general organization of the blind can be understood by referring to FIG. 1. Headrail 1 contains the lift system for blind 3 which is attached to the bottom of the headrail. The blind is lifted by two or more lift cords, of which only one, cord 5, is shown. These lift cords pass through the blind itself and attach to a bottom rail which is not shown. Within the headrail are cradles, of which one, cradle 7 is shown. Generally, one such cradle is used at the entry point of each lift cord into the headrail. Cradle 7, along with the other similar cradles, support shaft 9. Clip 11 is used to attach cord 5 to shaft 9. A similar clip would be used for each such cord. According to the principles of U.S. Pat. No. 4,623,012, as shaft 9 rotates, cord 5, along with the other lift cords, is wound about the shaft in a single layer to lift the blind. As seen in FIG. 1, several turns of cord 5 have already been wound onto shaft 9, partially raising blind 3.

Figure 2:
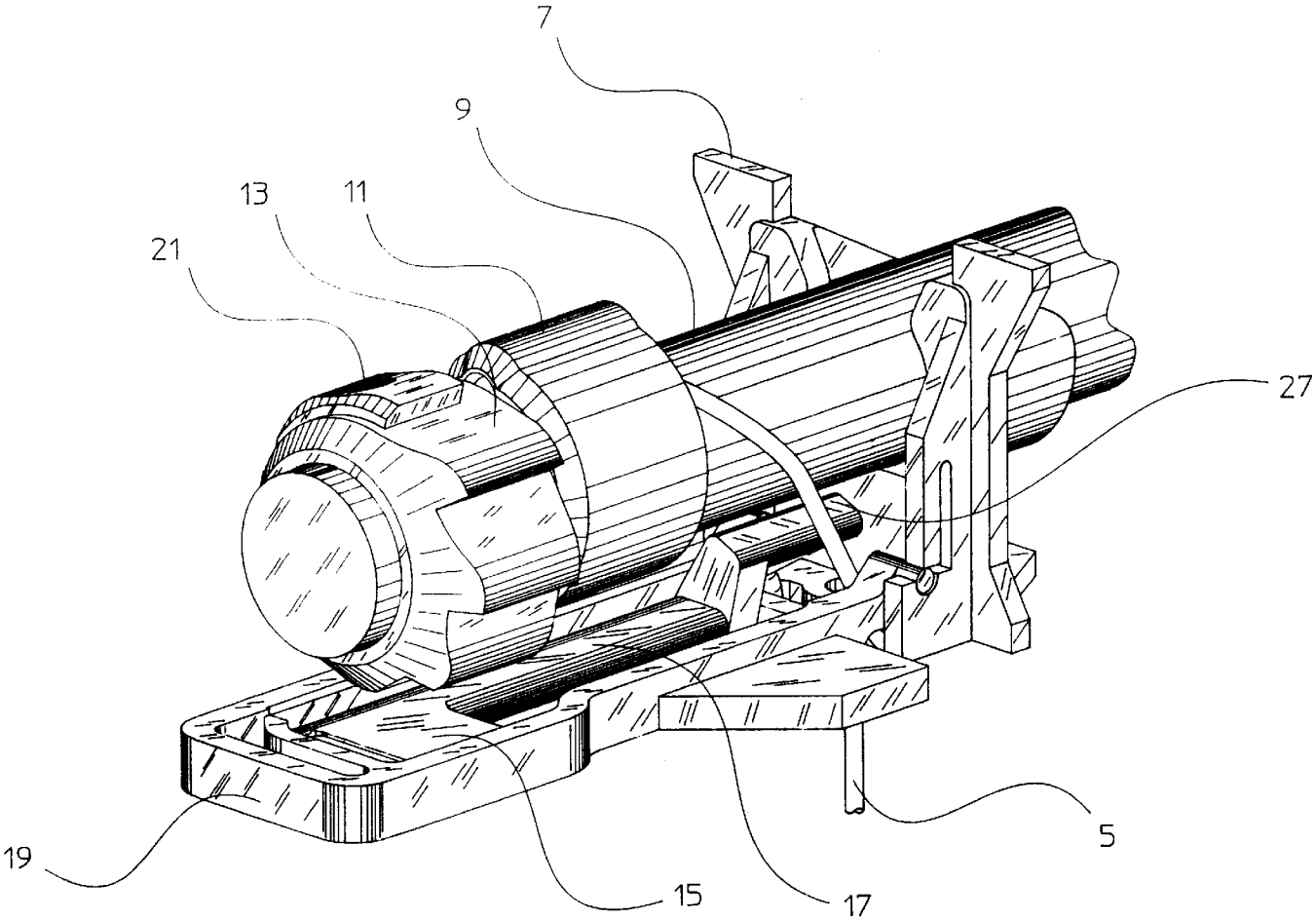
FIG. 2 is a perspective view of the parts shown in FIG. 1 that are internal to the headrail, but with the blind almost fully lowered.
Figure 3:
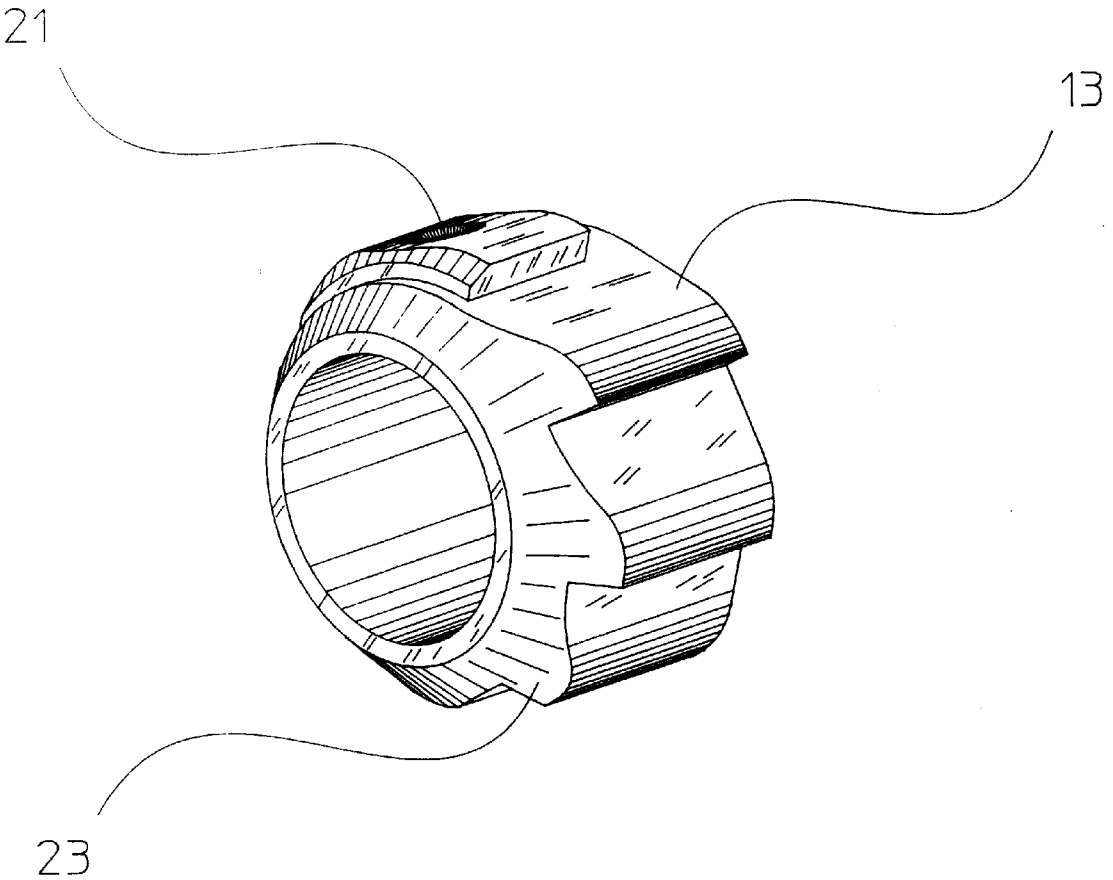
FIG. 3 is a perspective view of the ratchet wheel.

Headrail 1 and blind 3 have been omitted from FIG. 2 to better show the internal parts which comprise the invention and how they operate cooperatively with the lift system of the blind. Ratchet wheel 13 is mounted to shaft 9 in a position above pawl 15 of rocker 17. Rocker 17 is mounted in rocker cradle 19 in such a way that it can rotate through an angle of about 45 degrees.

Ratchet wheel 13 can be of molded plastic, die cast zinc, or other suitable materials. The inside diameter of ratchet wheel 13 fits over shaft 9, and is held in place by a set screw in threaded hole 21, or by any other suitable fastening means. One side surface 23 of ratchet wheel 13 has been chamfered to prevent lift cord 5 from becoming entangled on it.

Figure 4:
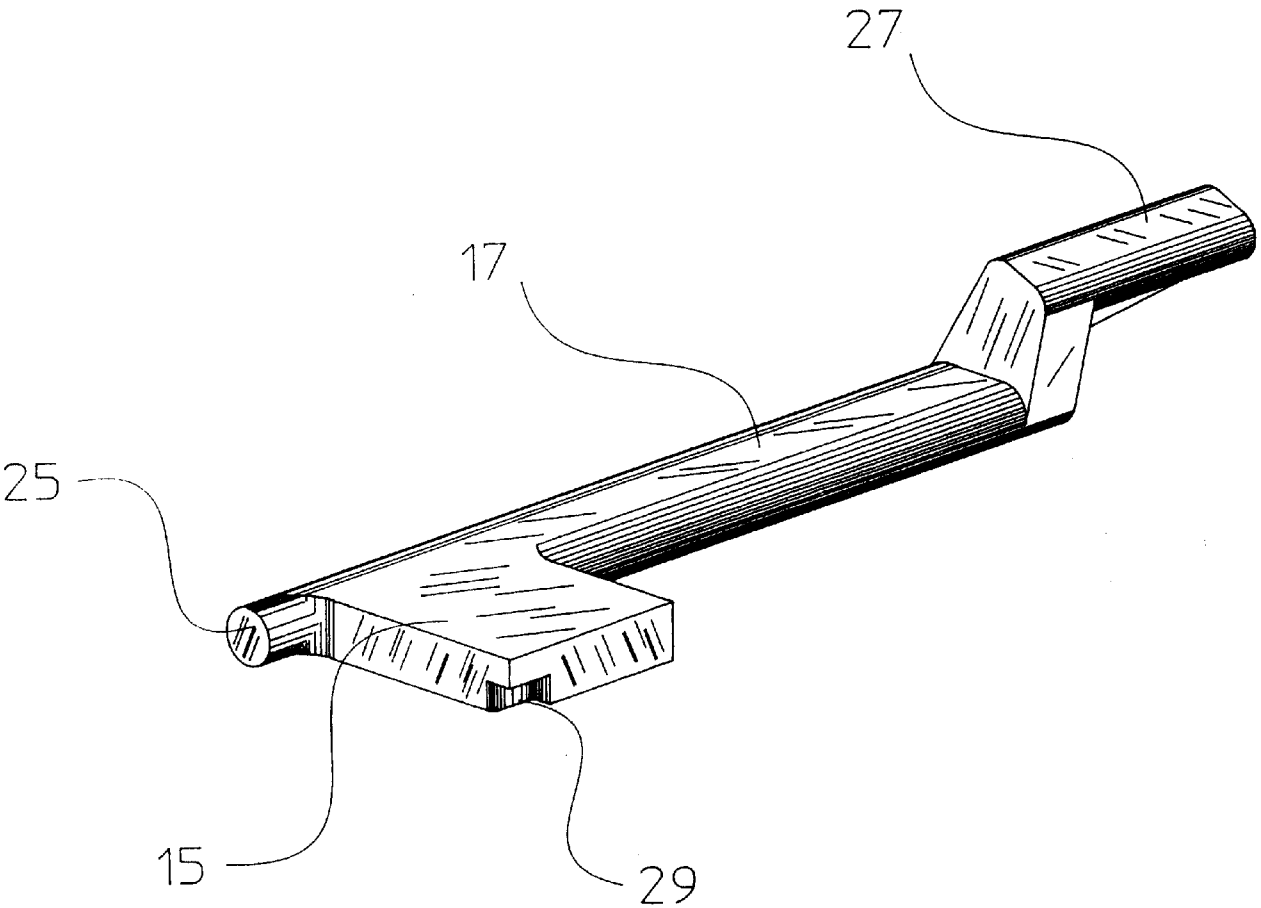
FIG. 4 is a perspective view of the rocker.
Figure 5:
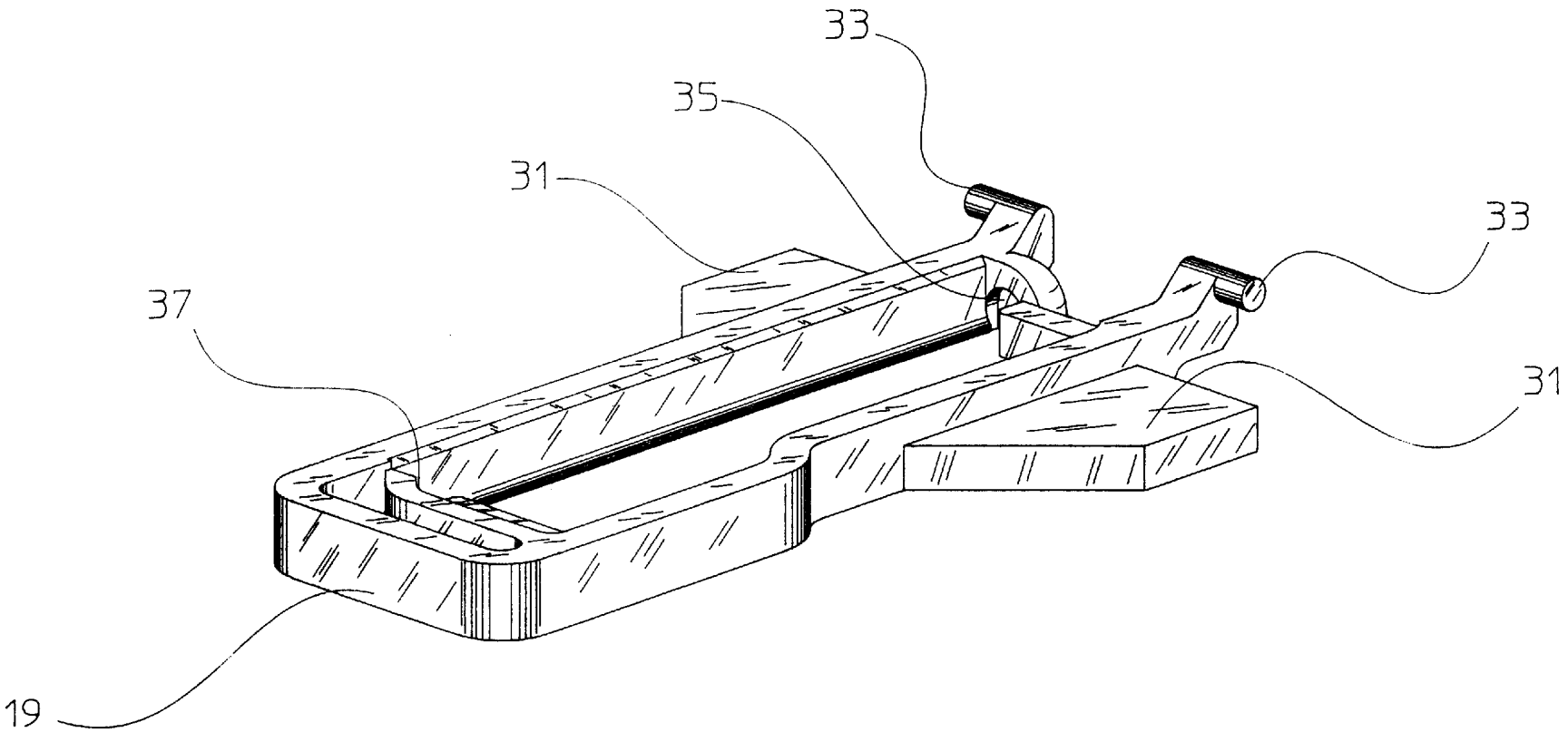
FIG. 5 is a perspective view of the rocker cradle.

Rocker 17 is, preferably, a molded plastic part having a cylindrically shaped axle pin 25 at each end for pivotal mounting in rocker cradle 19. Only one of two pins 25 are visible in FIG. 4, the other being hidden by actuating arm 27 at one end of rocker 17. Pawl 15 is at opposite end of rocker 17. Notch 29 is formed in one corner of pawl 15. Rocker cradle 19 has a matching feature that acts as a support for pawl 15 when rocker 17 is in the fully retracted position.

Figure 6:
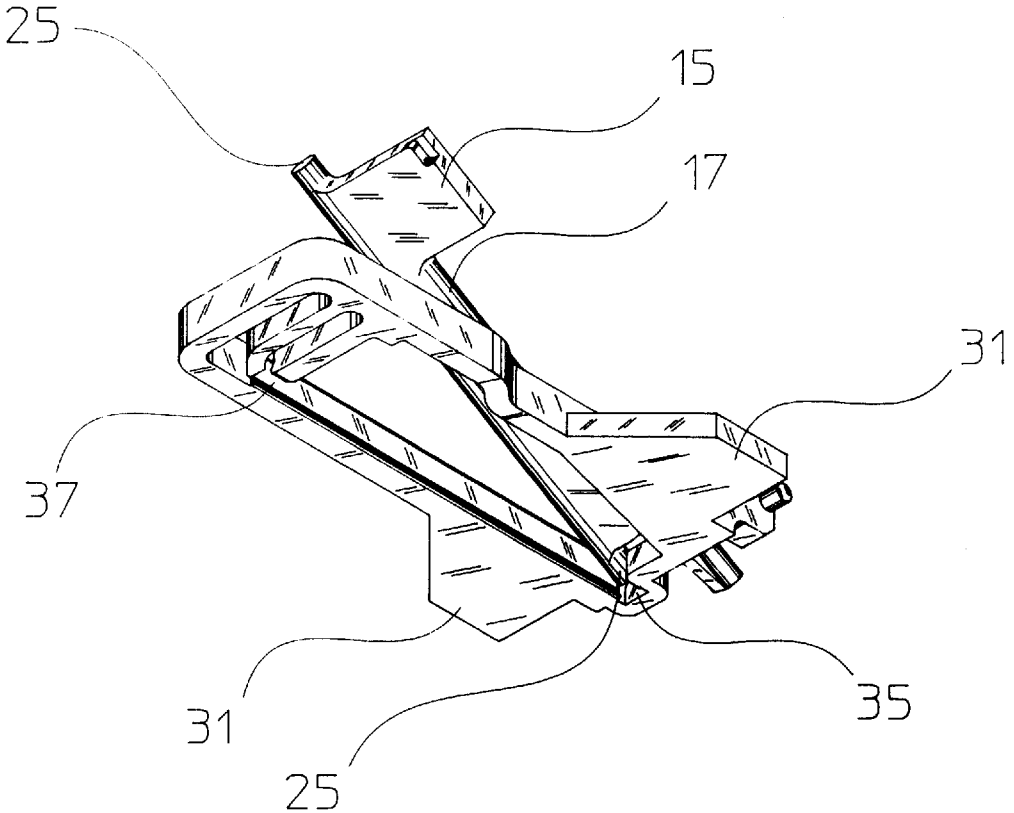
FIG. 6 is a perspective view of the rocker being fitted into the rocker cradle.

Rocker cradle 19 is also, preferably, a molded plastic part having wings 31 which are sized to keep the part centered within headrail 1. Pins 33 are formed for fitting into matching features on cradle 7 to hold rocker cradle 19 in its longitudinal position in headrail 1. Rocker cradle 19 has opening 35 for receiving one pin 25 as shown in FIG. 6. The assembly of rocker 17 with rocker cradle 19 is completed by snapping the other pin 25 into opening 37 of rocker cradle 19. Opening 35 is open on the bottom face for convenient molding, and closed on the top side to retain the pin against the bottom of the headrail. Opening 37 has a snap-in feature on the top side for retaining its pin 5.

Figure 7:
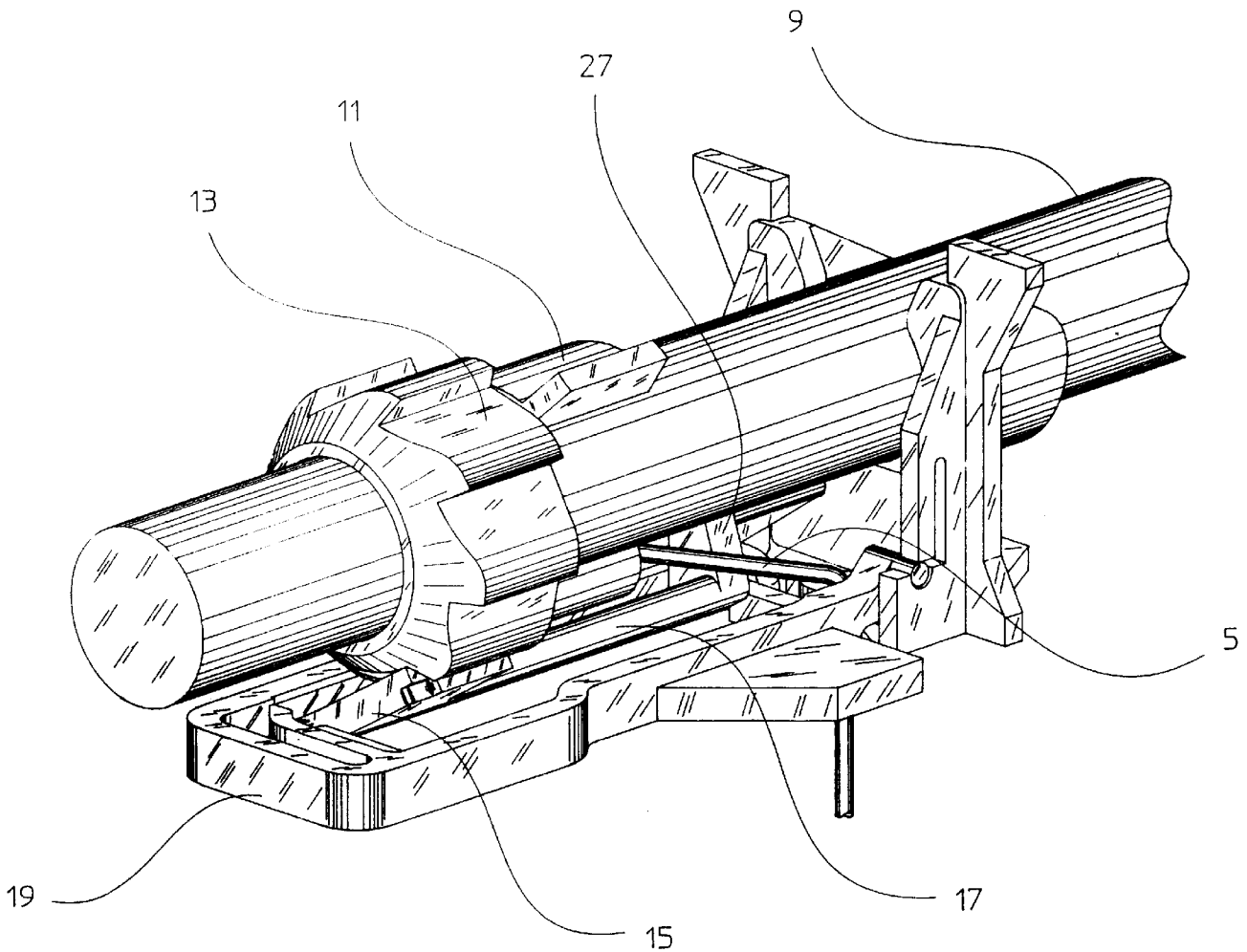
FIG. 7 is a perspective view of the bottom-stop mechanism in the bottom position; and, FIG. 8 is a perspective view of another embodiment of our invention.

Referring again to FIG. 2, when the blind is near the fully lowered position, cord 5 is almost completely unwound from shaft 9 as shown in FIG. 2. Further clockwise rotation of shaft 9 will bring cord 5 against actuating arm 27 causing rocker 17 to rotate. This rotation raises pawl 15 to engage the next tooth on ratchet wheel 13 arresting rotation of shaft 9, as shown in FIG. 7. Shaft 9 can no longer rotate in the clockwise direction, thereby providing a stop mechanism perfectly coordinated with the fully lowered position of the blind.

The blind is raised by counter-clockwise rotation of shaft 9 as seen in FIG. 2. This effects automatic release of the ratchet stop mechanism. The shape of the teeth on ratchet wheel 13 permits them to rotate even while pawl 15 is held against the ratchet wheel. However, as soon as cord clip 11 has rotated back to the position shown in FIG. 2, pawl 15 is returned to its retracted position in rocker cradle 19, ending any contact with ratchet wheel 13.

Figure 8:
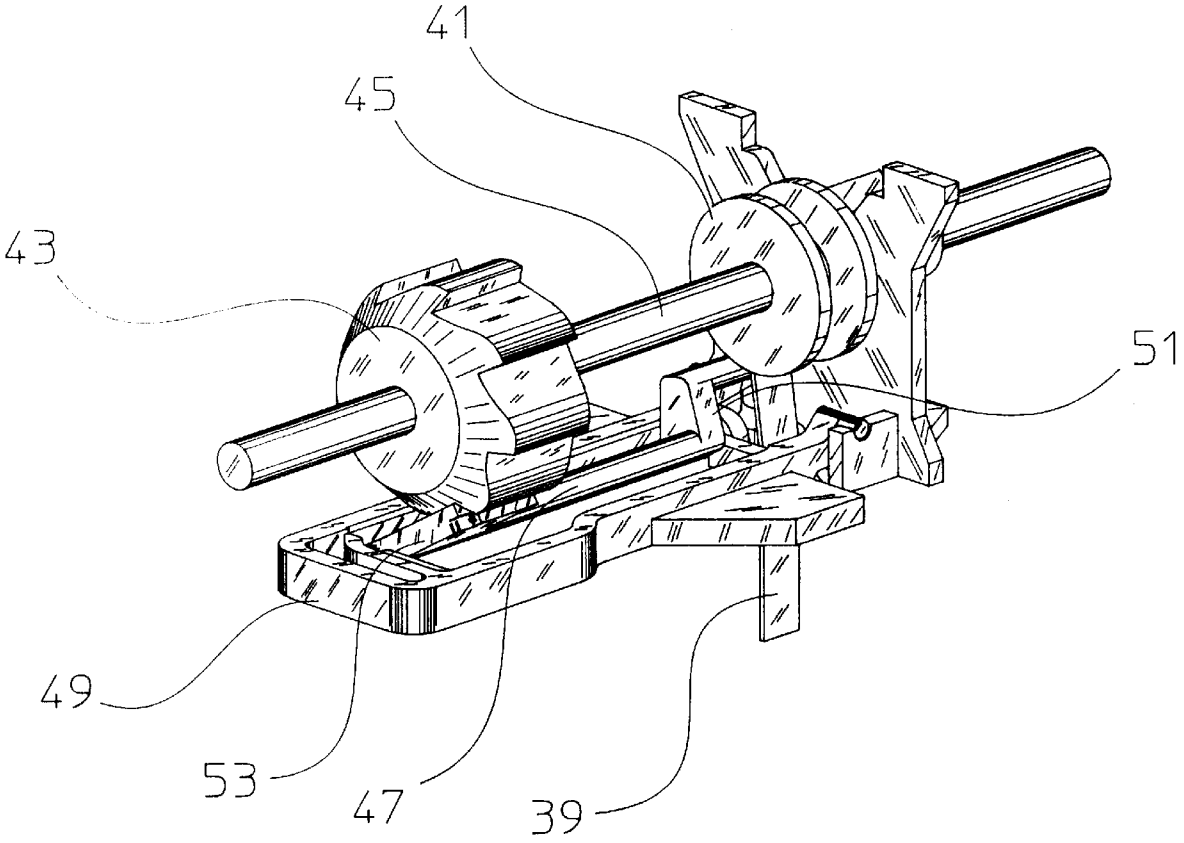

An alternative embodiment of our invention is shown in FIG. 8. This embodiment provides a bottom stop for a blind that is supported, raised and lowered by flat tape 39 that winds onto spool 41 in the headrail rather than a round cord. This embodiment uses generally the same configuration for ratchet wheel 43 is mounted onto shaft 45 along with spool 41. Rocker 47 is mounted in rocker cradle 49 as in the preferred embodiment. As this blind reaches its lowest position, the upper end of tape 39, which is attached to the core of spool 41, passes under shaft 45 and contacts actuating arm 51 of rocker 47, rotating pawl 53 to engage one of the teeth on ratchet wheel 43, preventing further counter-clockwise rotation of shaft 45.

It will thus be seen that the objects set forth above among those made apparent from the preceding description, are efficiently attained and, since certain changes may be made in the construction of the inventive stop mechanism without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A lifting and lowering system for a window covering having a bottom comprising:

a rotatable rod;

at least one lift cord for raising said covering from the bottom thereof and being responsive to said rod rotation for wrapping around said rod when said rod rotates in a first wrapping direction and for unwinding from said rod when said rod rotates in a second unwinding direction;

means for selectively engaging said cord once said cord is substantially completely unwound from said rod; and means responsive to said engaging means for inhibiting further rotation of said rod in said second unwinding direction.

2. The system of claim 1, further including means for supporting said rod.

3. The system of claim 2, wherein said supporting means comprises at least one cradle having a surface adapted to receive said rod and located where said at least one lift cord is attached.

4. The system of claim 1, wherein said detecting means comprises a pivotable rocker member.

5. The system of claim 4, wherein said rocker member includes an arm for selective engagement with said at least one cord when said at least one cord or tape is substantially completely unwound from said rod.

6. The system of claim 4, wherein said rocker member is rotatably mounted in a rocker cradle.

7. The system of claim 6, wherein said rocker cradle is in engagement with at least one cradle adapted for supporting said rod.

8. The system of claim 4, wherein said inhibiting means comprises a pawl and ratchet mechanism.

9. The system of claim 8, wherein said mechanism includes a ratchet wheel fitted over said rod.

10. The system of claim 9, wherein said rocker member supports said pawl member for selective engagement with said ratchet wheel in order to arrest said rotation in said unwinding direction.

11. The system of claim 10, wherein said ratchet wheel includes a plurality of teeth with one of which said pawl member selectively engages.

12. The system of claim 10, wherein said pawl member is selectively released from engagement with said ratchet wheel when said rod is rotated in said first wrapping direction.

13. The system of claim 10, wherein said rocker member includes an arm for selective engagement with said at least one cord when said at least one cord or tape is substantially completely unwound from said rod.

14. The system of claim 13, wherein said rocker member is rotatably mounted in a rocker cradle.

15. The system of claim 14, wherein said rocker cradle cooperatively engages at least one cradle for supporting said rod.

16. The system of claim 4, wherein said rocker member is pivotal through an angle of 45 degrees.

17. The system of claim 1, further including means for releasing said inhibiting means for enabling rotation of said rod in said first wrapping direction.

18. The system of claim 1, wherein said rod is a traversing rod such that said cord winds in a single layer therealong.

19. A lifting and lowering system for a window covering having a bottom comprising:

a rotatable rod;

at least one lift tape for raising said covering from the bottom thereof and being responsive to said rod rotation for wrapping around said rod when said rod rotates in a first wrapping direction and for unwinding from said rod when said rod rotates in a second unwinding direction;

means for selectively engaging said at least one lift tape once said tape is completely unwound from said rod; and means responsive to said engaging means for inhibiting further rotation of said rod in said second unwinding direction.

20. A lifting and lowering system for a window covering having a bottom comprising:

a rotatable rod;

at least one lift cord for raising said covering from the bottom thereof and being responsive to said rod rotation for wrapping around said rod when said rod rotates in a first wrapping direction and for unwinding from said rod when said rod rotates in a second unwinding direction;

a pivotal rocker member having an arm for selective engagement with said at least one cord when said at least one cord is completely unwound from said rod; and means responsive to said rocker member arm engaging said at least one cord for inhibiting further rotation of said rod in said second unwinding direction.

* * * * *